US005638947A

United States Patent [19]

Fenne

[11] Patent Number: 5,638,947

[45] Date of Patent: Jun. 17, 1997

[54] MODULAR TIMER HAVING MULTIPLE FINISHED EXTENSION MEMBERS

[75] Inventor: Kenneth R. Fenne, Glen Ellyn, Ill.

[73] Assignee: BRK Brands, Inc., Aurora, Ill.

[21] Appl. No.: 513,443

[22] Filed: Aug. 10, 1995

[51] Int. Cl.[6] ..... H01H 1/64

[52] U.S. Cl. ..... 200/293; 200/294; 174/66

[58] Field of Search ..... 200/293, 294; 174/48, 49, 66, 67, 50.51; D13/177, 162, 164

[56] References Cited

U.S. PATENT DOCUMENTS

| | | | |
|---|---|---|---|
| B1 Re. 31,848 | 12/1993 | Nilssen | 315/360 |
| D. 255,113 | 5/1980 | Pease et al. | D13/11 |
| 3,432,611 | 3/1969 | Gaines et al. | 174/66 |
| 3,735,020 | 5/1973 | Licata | 174/66 |
| 3,864,512 | 2/1975 | Meadow | 174/66 |
| 3,889,132 | 6/1975 | Vreeland | 307/141 |
| 3,939,361 | 2/1976 | Aidala et al. | 307/141 |
| 3,979,601 | 9/1976 | Franklin | 307/141 |
| 4,151,515 | 4/1979 | Pease et al. | 340/309.1 |
| 4,163,882 | 8/1979 | Baslow | 200/293 |

FOREIGN PATENT DOCUMENTS

| | | | |
|---|---|---|---|
| 2452173 | 6/1976 | Germany | 174/66 |

OTHER PUBLICATIONS

A set of 4 photographs of a switch plate and attendent accessories.

*Primary Examiner*—David J. Walczak
*Attorney, Agent, or Firm*—Dressler, Rockey, Milnamow & Katz, Ltd.

[57] ABSTRACT

A wall mountable timer switch adapted to be installed in standard single and multiple-ganged electrical connector boxes includes an elongated housing having an electrical timer circuit wherein the elongated housing includes first and second unfinished edges. Each of the unfinished edges defines an elongated mating surface which extends along a length thereof. The elongated mating surfaces are configured to receive an associated end termination element having at least one corresponding elongated mating surface for mating with one of the said mating surfaces of the first and second unfinished edges.

8 Claims, 5 Drawing Sheets

F
P
S
40
38
B
OFF
40
A
F
P
14
20
18
38
48
34
12
50
30
52
32
22
10
26
28
48
24
36
A
16

MODULAR TIMER HAVING MULTIPLE FINISHED EXTENSION MEMBERS

FIELD OF THE INVENTION

This invention pertains to modular, wall mounted timers. More particularly to modular, wall mounted timers having multiple, readily mountable finished extension elements.

BACKGROUND OF THE INVENTION

Appliance and light timers are known in the art. Such timers have a multitude of uses, for example, for switching lights on and off while on vacation, and for turning on and off various appliances at certain times of the day or night.

Known timers include a rotary type which has an analog clock-like dial and a receptacle or outlet for a load such as a lamp. Switches which are positioned on or adjacent to the dial are positionable to select times at which power is supplied to or removed from the load. Typically, the rotary type timer is plugged into a standard electrical receptacle.

There are several drawbacks to the rotary type timer. One major drawback is that the timer can inadvertently be disconnected or unplugged from the electrical receptacle rendering the timer inoperable. Another drawback to this type of timer is that generally the switches permit the times to be only approximately or roughly set. That is, the timer and the on-off switches are set to turn the appliance on and of at approximate times rather than providing an exact control of power to the load. Hence, close control of the time that power is supplied to or removed from the lights and/or appliances is at best difficult.

Another known class of timers is mountable to a standard electrical wall-switch box. This class of timer includes, in one form, a receptacle module mounted to a mounting plate which is mounted to the electrical connector box. A standard wall switch cover plate is mounted to the mounting plate.

The receptacle module is "hard-wired" to an electrical system. An electronic plug-in module, effectively a timer, is configured to plug into the receptacle module and mount over the wall switch cover plate.

Other wall switch timer products incorporate a fixed surround and are not used with existing switch face plates. These timers are usually intended for use in single switch boxes.

Thus, there continues to be a need for a modular timer which is configured to be easily installed in a standard wall mounted electrical box, and which is flexibly configured for adaptable use with single and multiple-ganged electrical boxes.

SUMMARY OF THE INVENTION

An electronic timer switch which is mountable in standard single and multiple-ganged electrical connector boxes includes an elongated housing having an electrical timing circuit and first and second unfinished, receiver edges. Each of the unfinished edges defines an elongated mating surface which is configured for mating with one of a plurality of elongated end finishing elements.

The end finishing elements are configured to match the size of the associated electrical connector boxes. That is, finishing elements are configured for single, double and triple, as well as other connector boxes, which may include electrical appliances in addition to the electronic timer switch, such as on-off switches, electrical receptacle outlets and the like.

In one embodiment of the invention, a backing plate extends between and connects a pair of finishing elements. The backing plate may include an opening therein configured to receive an interference member which extends from the back of the timer switch.

Other features and advantages of the present invention will be apparent from the following detailed description, the accompanying drawings, and the appended claims.

DETAILED DESCRIPTION OF THE PREFERRED EMBODIMENTS

Figure 1:
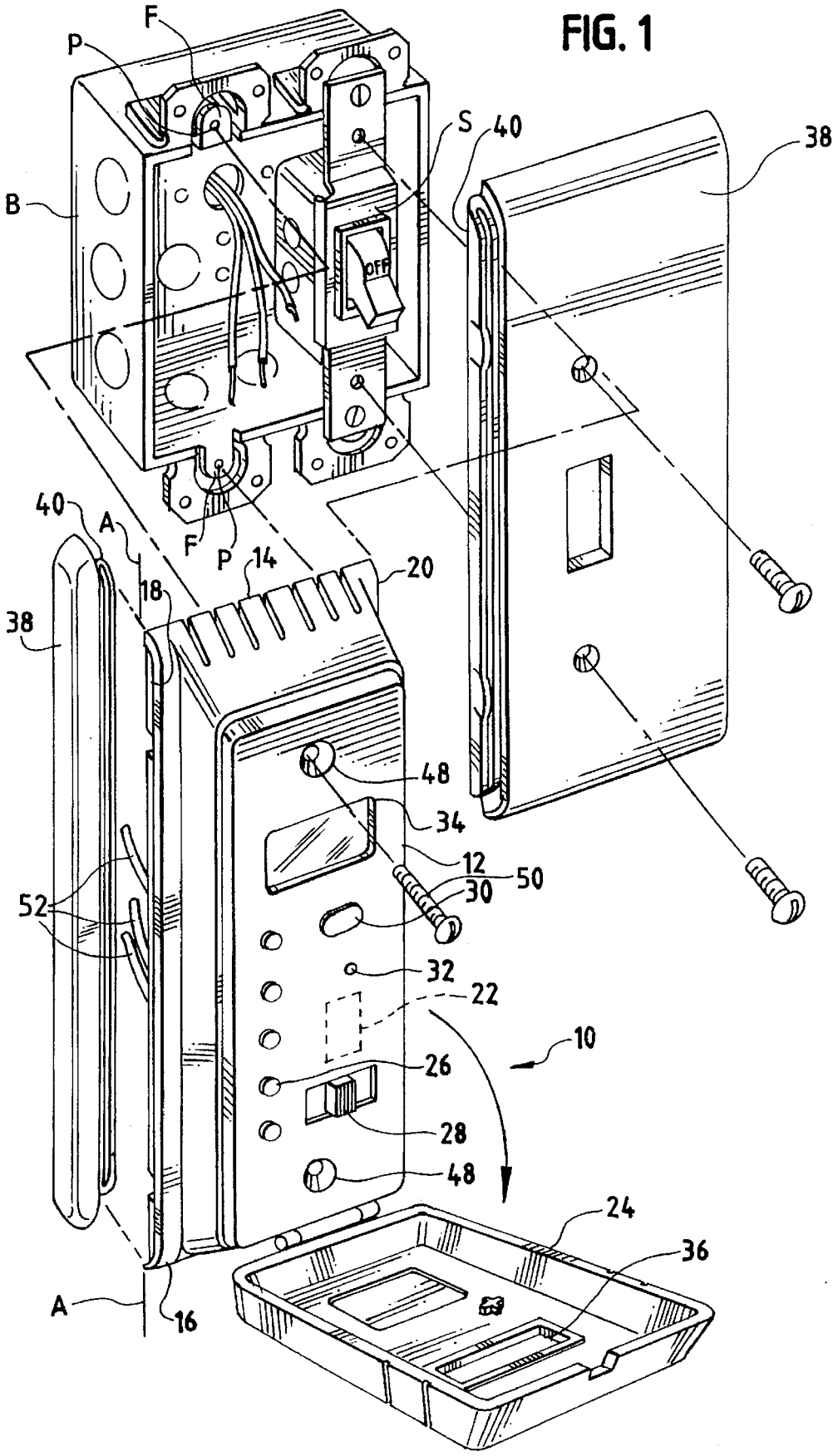
FIG. 1 is an exploded perspective view of a modular timer, shown with a single switch plate end finishing element embodying the principles of the present invention, illustrated with an associated double-ganged electrical connector box having a standard electrical switch located therein.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to FIG. 1, there is illustrated an electronic timer switch 10 having an elongated housing 12. The switch 10 is shown with reference to an associated, standard, double-ganged electrical connector box B having an exemplary standard electrical switch S located therein.

Figure 2:
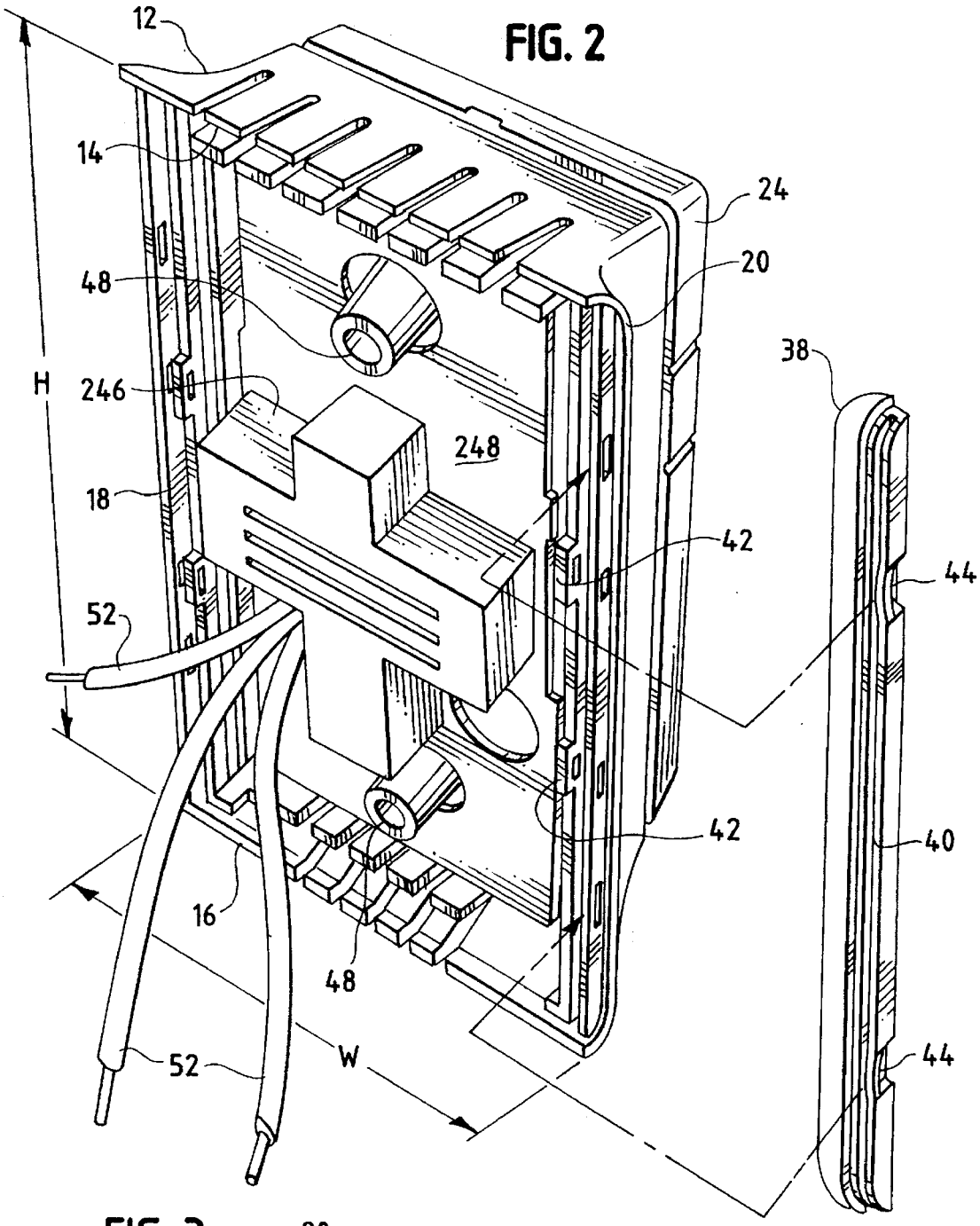
FIG. 2 is a rear perspective view of an embodiment of the modular timer of FIG. 1, having a rear extending interference member, shown with a front perspective view of a single plate end finishing element.
Figure 3:
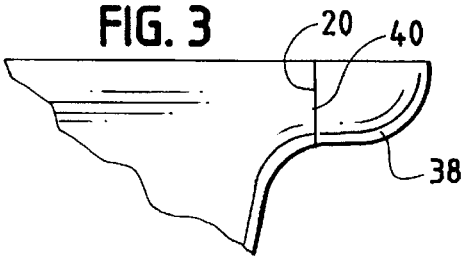
FIG. 3 is a partial sectional view of the modular timer of FIG. 1, showing the single plate and finishing element mounted thereto.
Figure 4:
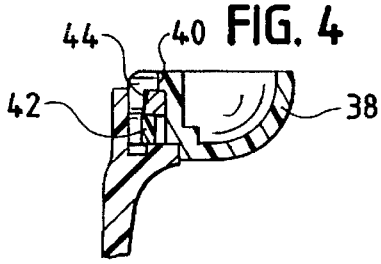
FIG. 4 is a partial cross-sectional view of the modular timer and finishing element of FIG. 3.

The housing 12 has first and second spaced apart finished edges 14, 16 along a predetermined width dimension W and first and second spaced apart unfinished mating surfaces or receiver edges 18, 20 along a predetermined height dimension H (see FIG. 2).

The illustrated timer 10 includes an electrical timer circuit 22 internal thereto, illustrated in phantom lines. As shown, the timer 10 includes a hinged door 24 which permits access to various switches 26 for, for example, setting the time of day, and presetting the desired times for switching on and off an associated electrical appliance or load, such as a lamp.

The timer 10 may also include a switch 28 for manually overriding the preset times for switching the associated appliance on and off. Other switches located on the timer 10 may include a power switch 30 and a reset switch 32. In addition, the timer 10 may also include an indicator 34 to indicate the time of day or the mode of operation of the timer. Preferably the door 24 includes an indicator opening or window 36 so that the indicator can be viewed with the door 24 in the closed position.

The height dimension H of the housing 12 is predetermined to be substantially consistent with the height dimension of a standard wall switch or electrical receptacle cover plate. In one known standard wall switch plate design, this dimension is about 4½ inches. It is to be understood that the height dimension H of the housing 12 can be made to match any size wall switch or receptacle cover plate.

The switch 10 further includes a plurality of edge finishing elements or end termination elements 38 which are releasably engageable with the unfinished receiver edges 18, 20. The edge finishing elements 38, various types of which are more fully described herein, have engaging surfaces 40 to facilitate secure yet releasable engagement between the finishing element 38 and the receiver edges 18, 20.

In one embodiment, as illustrated in FIG. 2, the receiver edge 18, 20 includes at least one outwardly extending locking member 42, and the finishing element 38 includes a complimentary locking notch 44. This configuration can, of course, be reversed, with the locking member 42 extending from the finishing element 38 and the locking notch 44 being formed in the receiver edge 18, 20.

It is also to be recognized that each of the receiver edges 18, 20 and the finishing elements 38 may include a plurality of the same of complimentary locking members 42 and notches 44, with the understanding that the other of the receiver edges 18, 20 and the finishing elements 38 includes a complementary set of locking elements 42, 44.

Figure 5:
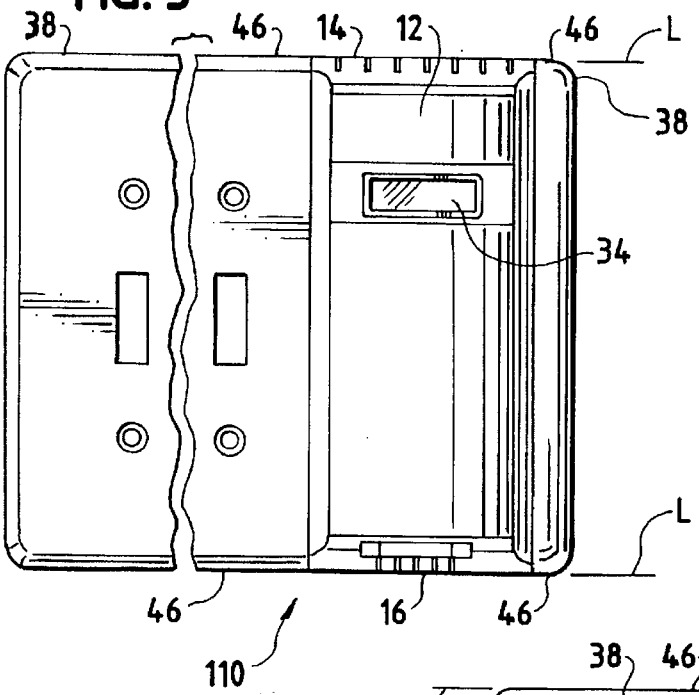
FIG. 5 is a front plan view of the modular timer illustrated with a double switch plate end finishing element.
Figure 6:
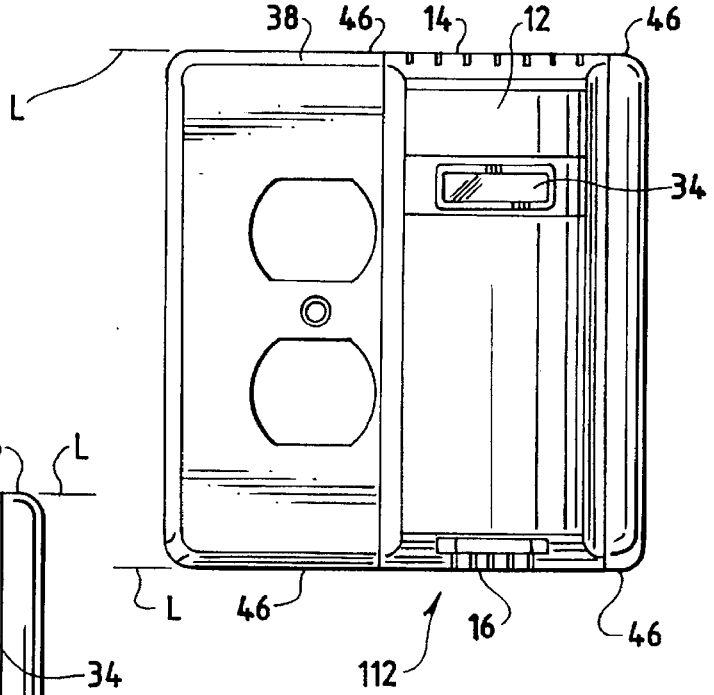
FIG. 6 is a front plan view of the modular timer illustrated with a double outlet plate end finishing element.
Figure 7:
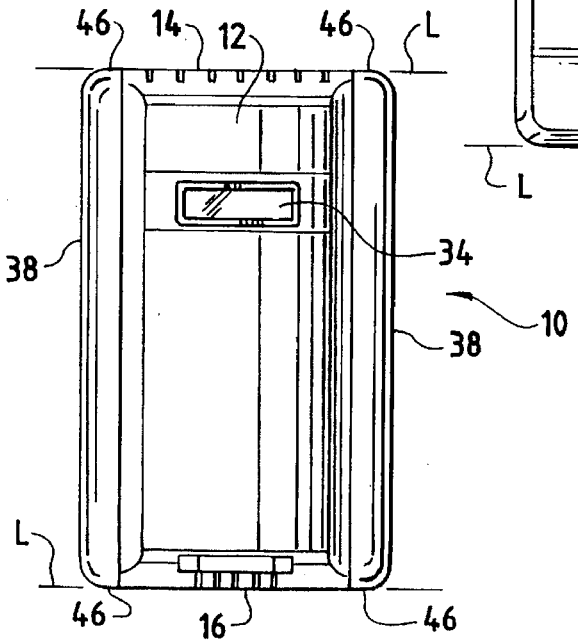
FIG. 7 is a front plan view of the modular timer illustrated with a pair of single plate edge finishing elemental.

As best seen in FIGS. 5 through 7 the locking members 42 and notches 44 are configured such that the ends of the finishing element 46 align with a line L formed by the finished edges 14, 16 of the housing 12 when the finishing element 38 is mounted to the timer housing 12.

In a preferred embodiment of the invention, the edge finishing elements 38 mount to the housing 12 by engaging the locking members 42 and notches 44 and rotating the element 38 forwardly, about an axis A (see FIG. 1) along the receiver edge 18, 20, until the finishing element 38 is flush with the housing 12. Conversely, the finishing elements 38 release from the receiver edges 18, 20 by rotating the finishing elements 38 rearwardly of the timer switch 10, about the axis A and disengaging the locking members 42 from the notches 44. This configuration permits ready assembly of the finishing elements 38 to the timer switch 10 by a simple hook and rotate procedure.

Advantageously, such a configuration also prevents inadvertent removal of the finishing elements 38 from the timer switch 10 when the switch 10 is mounted to a wall. The finishing elements 38 which are flush with the wall, cannot be rotated rearwardly to release from the housing 12.

As illustrated in FIGS. 7, the finishing elements 38 can be mounted to the timer housing 12 such that the assembly has a width substantially equal to the width of a single wall switch cover plate.

Alternatively, assemblies 110, 112 such as those illustrated in FIGS. 5 and 6 can be configured to have a width equal to that of a multiple-ganged (e.g., a double or triple width) wall switch cover plate. The multiple-ganged wall switch cover plate 110, 112 can accommodate any number of appliances such the exemplary standard light switch S illustrated in FIG. 1, dimmer switches, "designer" switches, electrical receptacle outlets and the like.

Figure 9:
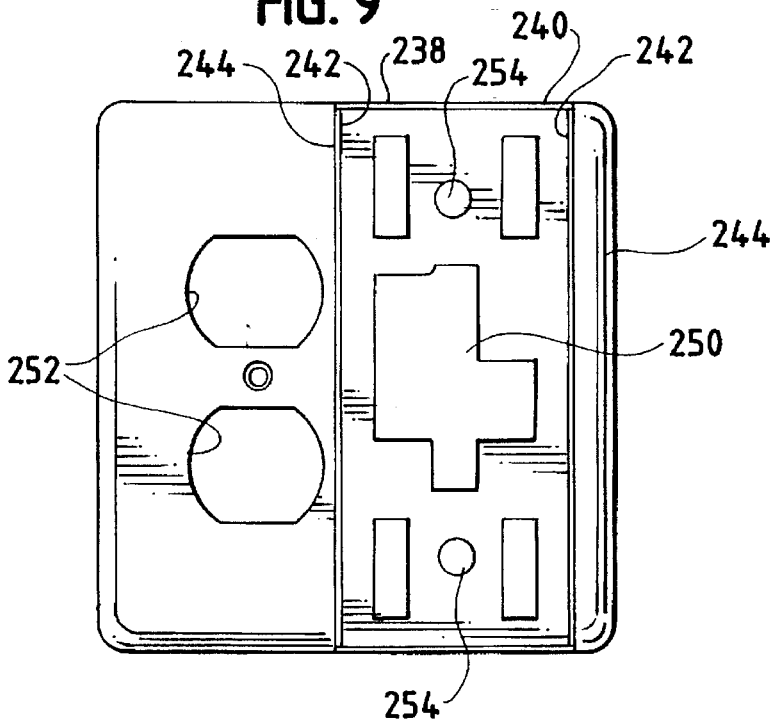
FIG. 9 is another end finishing element of the embodiment of FIG. 8 for use with an associated double outlet.
Figure 10:
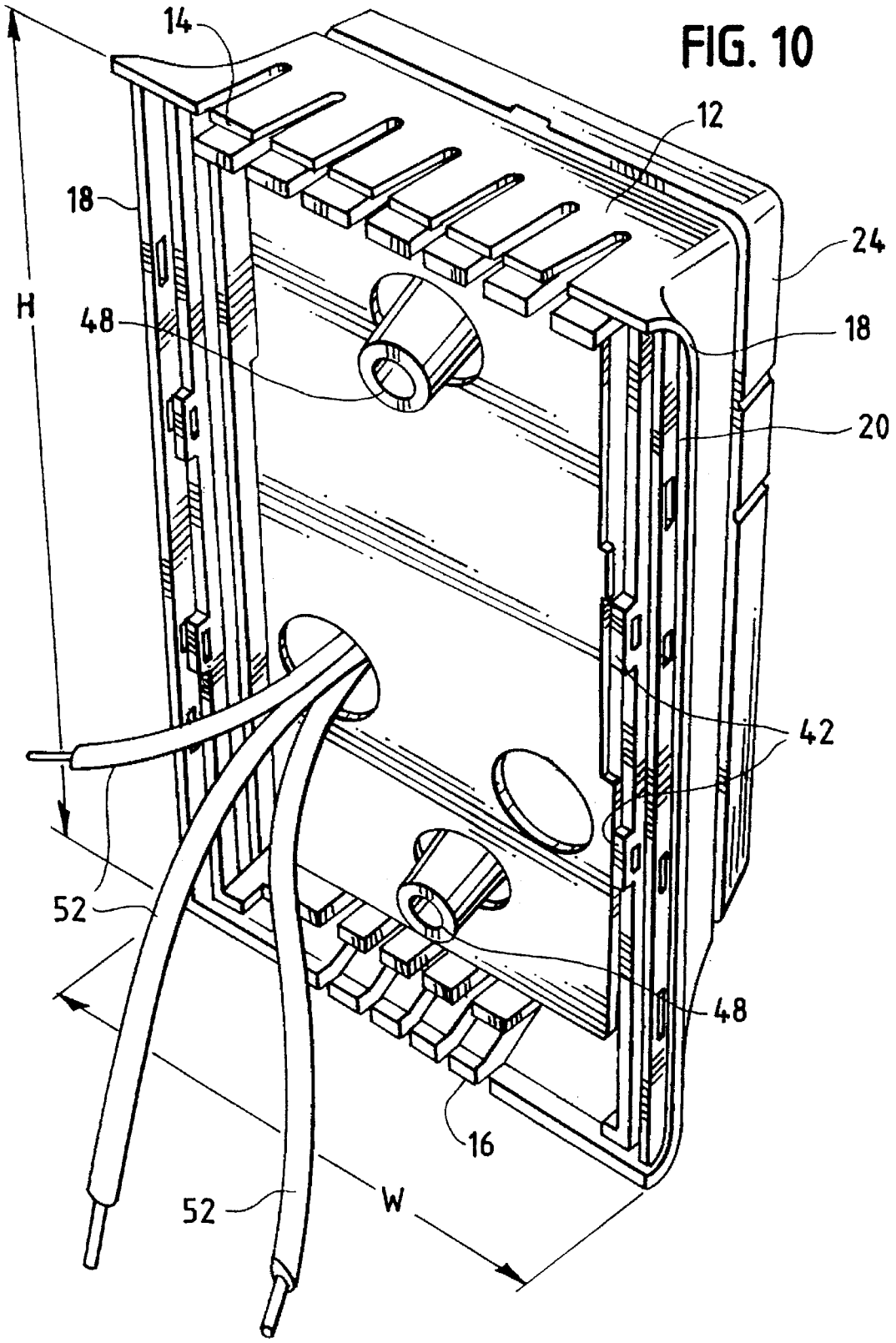
FIG. 10 is an alternate embodiment of the modular timer similar to FIG. 1, without an interference member extending from the rear of the timer housing.

In a preferred embodiment, the timer switch 10 defines a pair of apertures 48, as shown in FIGS. 1 and 9, through which fasteners, such as metal screws 50, can be inserted to mount the switch 10 to an associated, standard electrical connector box B. The timer 10 is connected, by wires 52, to the wires W for the appropriate electrical circuit which is to be controlled (not shown) as the circuit wires W extend into the box B. The timer 10 is then fastened to the box B, as described above.

Many of the commonly used electrical connector boxes B have flanges or tabs F which include threaded apertures P therein, which apertures P are set at a standard distance apart, about 3¼ inches. The apertures 48 in the timer switch 10 are also set apart by about this standard dimension, 3¼ inches. This permits mounting the switch 10 directly to the electrical connector box B.

Figure 8:
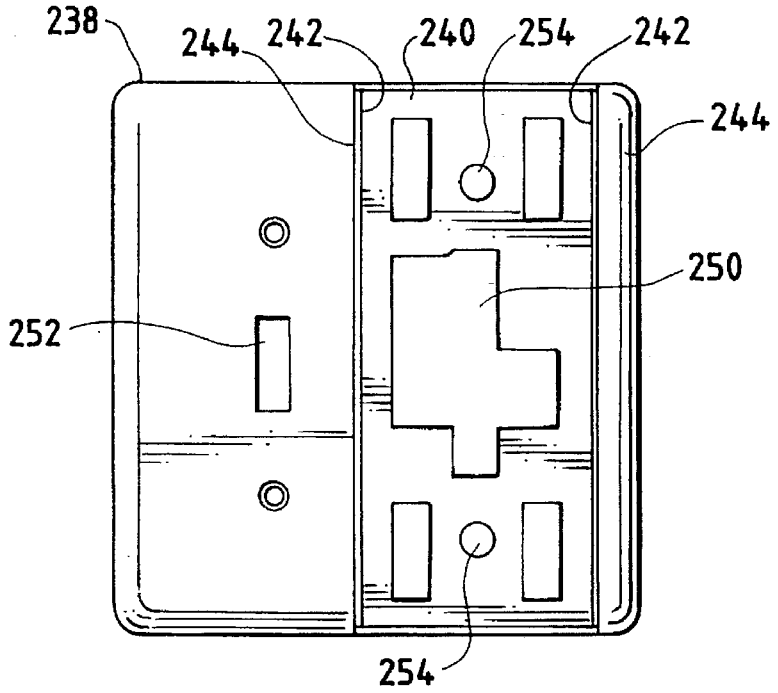
FIG. 8 is an alternate embodiment of an end finishing element for use with an associated single electrical switch.

In an embodiment of the finishing element 238 illustrated in FIGS. 7 and 8, the finishing element 238 has a backing plate 240 which extends between and connects a pair of mating surfaces 242 which are adjacent to the finished edges 244. Essentially, the switch housing 12 mounts to the backing plate 240 and mating surface 242 to position the finished edges 244 along the height dimension H of the housing 12.

This embodiment may further include an interference member 246 extending rearwardly from a rear surface 248 of the timer switch 10. The backing plate 240 may have a corresponding opening 250 therein for receiving the interference member 246. This configuration prevents use of the timer switch 10 with a cover plate which is not intended for use with the switch 10, such as a standard wall switch cover plate.

As with the embodiment illustrated in FIGS. 5 and 6, the finishing elements 238 of this embodiment can include any combination of openings 252 for accommodating appliances such as standard light switches, dimmer switches, "designer" switches, electrical receptacle outlets and the like. The backing plate 240 may include apertures 254 formed therein which are in alignment with the apertures 48 of the switch 10 to permit mounting to a standard electrical connector box B.

The finishing elements 38, 238 of the present invention are symmetrical relative to the timer housing 12. That is, the receiver edges 18, 20 of the housing 12 and the engaging surfaces 40 of the finishing elements 38 are configured to permit any of the finishing elements 38 to be mounted to either side of the housing 12. This necessarily reduces the overall number of parts in that the elements 38 are interchangeable as they mount to the housing 12. This further facilitates installation of the timer 10 because specifically oriented finishing elements 38 are not needed.

Advantageously, this configuration also permits the timer housing 12 to be located at an end of or between any two finishing elements 38. This can include an arrangement in which the housing 12 is mounted between, for example, two switch plate or receptacle elements 38, such as the elements 38 illustrated in FIGS. 5 and 6, as well as the single plate arrangement shown in FIG. 7.

It will be recognized by those skilled in the art that any number and combination of openings can be formed in the finishing elements 38, 238, and the finishing elements 38, 238 can be provided in sizes to accommodate any number of appliances and to fit single as well as multiple-ganged electrical box connectors, which combinations and sizes are intended to be within the scope of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An electronic switch comprising:

an elongated housing including an electrical timer circuit wherein said elongated housing includes first and second unfinished edges, each of said edges defining an elongated mating surface extending along a length thereof, said housing further including an interference member extending from a rear surface thereof;

at least one end termination element having two corresponding elongated mating surfaces, each said surface configured to mate with one of said mating surfaces of said first and second edges, wherein said end termination element includes a backing plate extending between and connecting said two corresponding mating surfaces, wherein said backing plate defines an opening therein for receiving said interference member.

2. A switch as in claim 1 wherein said end termination element is configured to constitute a single wall switch plate.

3. A switch as in claim 2 wherein said end termination element includes at least one opening therein for receiving at least one of a switch and an electrical outlet.

4. A switch as in claim 1 wherein said end termination element is configured to constitute a multiple-ganged wall plate.

5. A switch as in claim 1 including at least one mounting member for mounting said switch to an associated electrical connector box.

6. A switch as in claim 5 wherein said at least one mounting member includes at least one aperture formed therein being configured to receive a fastener therethrough for fastening said switch to the electrical connector box.

7. A switch as in claim 1 wherein said end termination element is symmetrical relative to said housing and is engageable with said elongated mating surfaces of both of said first and second unfinished edges.

8. An electronic switch comprising:

an elongated housing including an electrical timer circuit wherein said elongated housing includes first and second unfinished edges, each of said edges defining an elongated mating surface extending along a length thereof, said housing further including an interference member extending from a rear surface thereof;

first and second end termination elements, each said end termination element having an elongated mating surface configured to mate with one of said mating surfaces of said first and second edges, wherein said end termination elements are adapted to engage and mate with said housing to constitute one of a single gaged wall plate and a multiple ganged wall plant;

wherein said interference member is configured to interfere with mounting said switch to an electrical connector box having a wall plate mounted thereto; and wherein said first and second end termination elements include a backing plate extending therebetween connecting said first and second end termination elements.

* * * * *